US008113887B2

(12) United States Patent
Osawa et al.

(10) Patent No.: US 8,113,887 B2
(45) Date of Patent: Feb. 14, 2012

(54) CARD CONNECTOR AND ELECTRONIC APPARATUS INCLUDING THE SAME

(75) Inventors: Satoshi Osawa, Kawasaki (JP); Akira Tamura, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/887,075

(22) Filed: Sep. 21, 2010

(65) Prior Publication Data

US 2011/0070749 A1 Mar. 24, 2011

(30) Foreign Application Priority Data

Sep. 24, 2009 (JP) ..... 2009-219491

(51) Int. Cl.
*H01R 24/00* (2006.01)

(52) U.S. Cl. ..... 439/637

(58) Field of Classification Search ..... 439/637, 439/660, 839

See application file for complete search history.

(56) References Cited

U.S. PATENT DOCUMENTS

| | | | | |
|---|---|---|---|---|
| 4,476,400 | A * | 10/1984 | Jo et al. | 307/147 |
| 4,534,610 | A * | 8/1985 | Takihara | 439/712 |
| 5,059,133 | A * | 10/1991 | Hikami et al. | 439/161 |
| 6,645,012 | B2 | 11/2003 | Ito et al. | |
| 6,857,908 | B2 * | 2/2005 | Burmeister | 439/632 |
| 7,011,533 | B2 * | 3/2006 | Miyamoto | 439/95 |

FOREIGN PATENT DOCUMENTS

| | | |
|---|---|---|
| JP | 07-18387 | 3/1995 |
| JP | 2001-126791 | 5/2001 |
| JP | 2002-56910 | 2/2002 |

* cited by examiner

*Primary Examiner* — Phuong Dinh

(74) *Attorney, Agent, or Firm* — Squire Sanders (US) LLP

(57) ABSTRACT

There is provided a card connector for electrically coupling a card with a motherboard. The card connector includes a housing to and from which a contact pad of the card is inserted and ejected, where the housing is mountable on the motherboard; a pair of contacts is configured to hold the card between the pair of the contacts and to be electrically coupled with the contact pads of the card inserted into the housing, and extend in a first direction, and a pair of urging members is configured in the housing to force the pair of the contacts toward the card and extend in a second direction opposite to the first direction.

14 Claims, 3 Drawing Sheets

CARD CONNECTOR AND ELECTRONIC APPARATUS INCLUDING THE SAME

CROSS-REFERENCE TO RELATED APPLICATION

This application is based upon and claims the benefit of priority of the prior Japanese Patent Application No. 2009-219491, filed on Sept. 24, 2009, the entire contents of which are incorporated herein by reference.

FIELD

The embodiments discussed herein are related to a card connector and an electronic apparatus including the same.

BACKGROUND

There is known a card connector mounted on a motherboard for electrically coupling the motherboard with a card inserted into the card connecter. Further, there is known a mechanism for preventing a card from incorrectly being ejected from a card connector. Several kinds of connectors for cards are disclosed in, for example, Japanese Laid-open Patent Publications No. 2001-126791 and 2002-56910, and Japanese Publication of Unexamined Utility Model Application 07-18387.

SUMMARY

According to an aspect of the invention, there is provided a card connector for electrically coupling a card with a motherboard. The card connector includes a housing to and from which a contact pad of the card is inserted and ejected, where the housing is mountable on the motherboard; a pair of contacts configured to hold the card between the pair of the contacts and to be electrically coupled with the contact pads of the card inserted into the housing, the pair of contacts extending in a first direction; and a pair of urging members configured in the housing to force the pair of the contacts toward the card, the pair of the urging members extending in a second direction opposite to the first direction.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

As an existing mechanism preventing the card from incorrectly ejecting or dropping off is usually assembled not to the card connector but to the motherboard or the connector. Thus, assembling of the mechanism results in increase of the man-hour. Therefore, it is preferable to provide a card connector and an electronic apparatus including the same.

Several embodiments will be described with reference to the figures.

First Embodiment

Figure 1A:
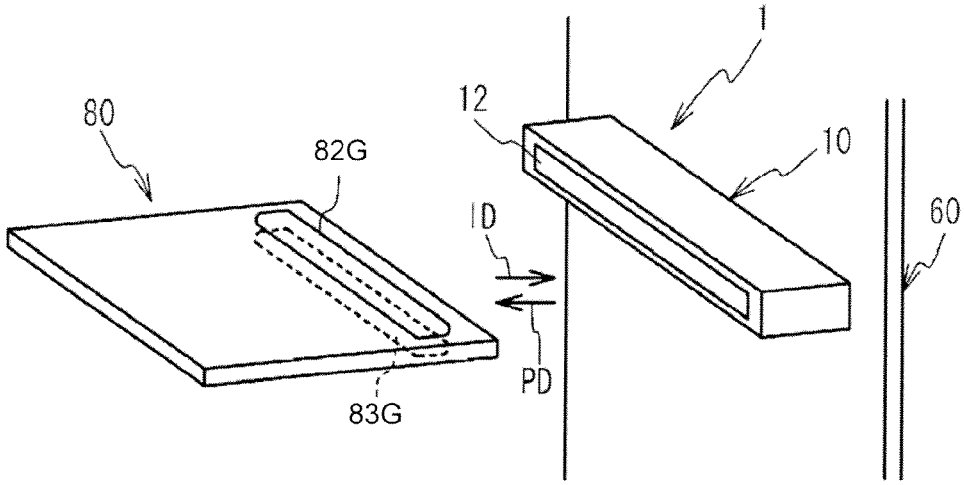
FIG. 1A is a diagram illustrating a relationship between a card and a card connector according to a first embodiment and FIG. 1B is a diagram illustrating an inner configuration of the card connector.

A card connector according to the first embodiment will described with reference to FIGS. 1A and 1B. FIG. 1A illustrates the relationship among the card connector 1 mounted on a motherboard 60 and the card 80 when the card 80 is inserted along the card insertion direction ID or drew along the card ejection direction PD from the card connector 1. The card connector 1 includes a housing 10 by which the card connector 1 is fixed to the motherboard 60. The housing is made of resin such as synthetic resin. An opening 12 is provided at a face of the housing 10 for the card 80 insertion and drawing into or from the card connector 1. A size of the opening 12 is sufficient for inserting and drawing the card 80 with contact-pad groups 82G and 83G secured on the individual surfaces of the card 80.

The contact-pad group 82G is provided at a portion along an edge of the card 80. The contact-pad group 83G, which will be described in detail later, is also provided in a same way on the rear surface of the card 80. The contact-pad group 82G includes a plurality of contact-pads which are separated from each other. Each contact-pad of the contact-pad group 83G contacts with a corresponding contact described later. The card 80 is a small size printed circuit board such as a memory card or a video card or the like. The card connector 1 and the motherboard 60 are mounted in an electronic apparatus such as a server or a personal computer or the like. The motherboard 60 in the first embodiment maintains a vertical position in normal usage of the electronic apparatus. Accordingly, the card 80 is inserted into or ejected from the card connector 1 along the direction perpendicular to the motherboard 60.

Figure 1B:
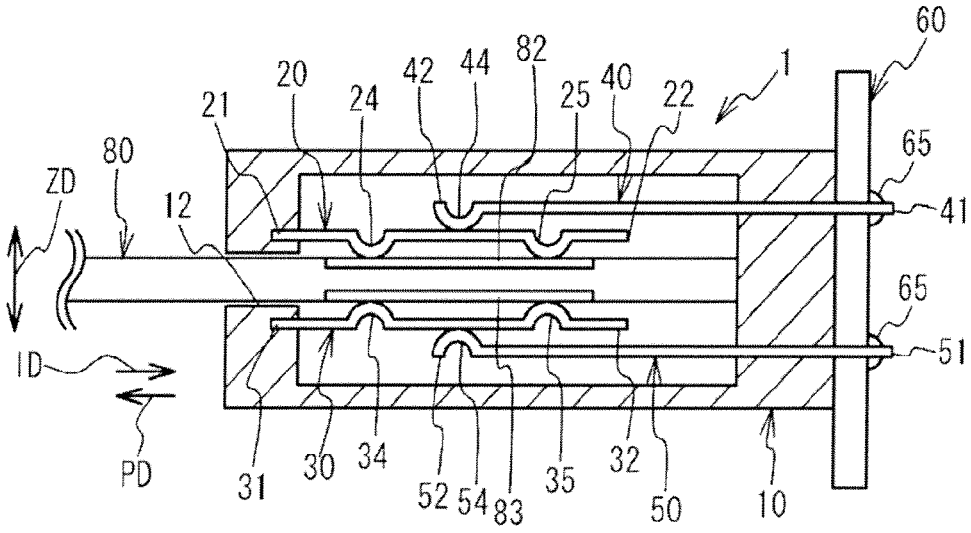

The inner configuration of the card connector 1 is illustrated in FIG. 1B, which depicts a state when the card 80 has been inserted into the card connector 1. As illustrated in FIG. 1B, on the respective surfaces of the card 80 disposed are the contact pads 82 and 83, to which the contacts 20 and 30 provided in the housing 10 contact respectively. The plurality of the contact pads 82 and 83 are included in the card 80, while the contact pads 82 and 83 each are illustrated as single in FIG. 1A. The contacts 20 and 30 are also disposed as many as the contact pads 82 and 83, respectively and secure the card 8 between the contact pads 82 and 83.

In the housing 10, there are provided urging members 40 and 50 for actuate the contacts 20 and 30 respectively toward to the card 80, that is, in the direction of the thickness of the card 80. The contacts 20 and 30 and the urging members 40 and 50 are made of metal, thus they are electrically conductive and resilient. Accordingly, the card 80 and the motherboard 60 may be electrically connected each other through the contacts 20 and 30 and the urging members 40 and 50. The urging members 40 and 50 may be provided as may as the plurality of contact 20 and 30, further single urging members 40 and 50 are preferably configured to actuate several contacts 20 and 30 respectively.

As illustrated in FIG. 1B, the fixed end 21 of the contact 20 is secured at the tip end side or distal end side (portion) of the housing 10, that is, at the far end of the housing 10 from the motherboard 60. The fixed end 21 is pressed into a hole provided at the inner wall of the tip end side. The free end 22 of contact 20 is positioned at the base portion side or proximal portion side of the housing 10, that is, at the motherboard 60 side. As illustrated in FIG. 1B, the contact 20 extends from the fixed end 21 to the free end 22 toward to the motherboard 60. That is, the contact 20 extends along the card insertion direction ID for inserting the card 80. The contact 20 made of a thin plate has a plurality of contact portions such as contact portions 24 and 25 each formed in a curved shape like an arc. Both of the contact portions 24 and 25 contact to the contact pad 82.

The contact 30 has a structure same to that of the contact 20, and extends from the fixed end 31 to the free end 32 along the card insertion direction ID. The contact 30 has the contact portions 34 and 35 for contacting to the corresponding contact pads 83. The distance between the contacts 20 and 30 is set so that the distance between the contact portions 24 and 34, for example, is a little smaller than the thickness of the card 80 when the card is not inserted into the connector 1. When the card 80 is inserted between the contacts 20 and 30, the contacts 20 and 30 hold the card 80 therebetween by the resilient force of the contacts 20 and 30.

The urging members 40 and 50 actuate the corresponding contacts 20 and 30 to move close to each other. The fixed end 41 of the urging member 40 is connected to the motherboard 60 through the base portion of the housing 10. For detail, the fixed end 41 is fixed to the motherboard 60 by the fixing part 65 after to be passed through a hole provided to the motherboard 60. The fixed end 41 is electrically connected to a wiring pattern formed on the motherboard 60. As illustrated in FIG. 1B, the free end 42 positions at the tip end side of the housing 10.

The urging member 40 extends from the fixed end 41 to the free end 42 toward to the tip end side of the housing 10, that is , the urging member 40 extends along the card ejection direction PD. A contacting portion 44 is formed in a curved shape like an arc and positioned at the free end 42 side on the urging member 40. The contacting portion 44 contacts to the contact 20 at a portion between the contact portions 24 and 15 to urge the contact 20 in a direction toward the card 80. The contact 20 and the urging member 40 extend in opposite directions each other.

The urging member 50 has a structure similar to that of the urging member 40, extending in a direction along the card ejection direction PD. The urging member 50 includes the contacting portion 54 which makes contact with the contact 30 at a portion between the contact portions 34 and 35 to urge the contact 30 toward the card 80. The fixed end 51 of the urging member 50 is electrically connected to the motherboard 60. The urging member 50 and the contact 30 extend in opposite directions each other.

As described above, the urging members 40 and 50 urge the contacts 20 and 30 toward the card, respectively. Even in the case of vibrating in the direction ZD of thickness of the card 80, the contact portions 24 and 25 and the contact portions 34 and 35 are forced toward the contact pads 82 and 83, respectively, where the direction ZD is perpendicular to the both directions PD and ID. Accordingly, the contact pad 82 is allowed to continuously contact to the contact portions 24 and 25 as same as the contact pad 83 to the contact portions 34 and 35. Therefore, the urging members 40 and 50 prevent the card 80 from being dropped off from the housing 10.

Figure 2A:
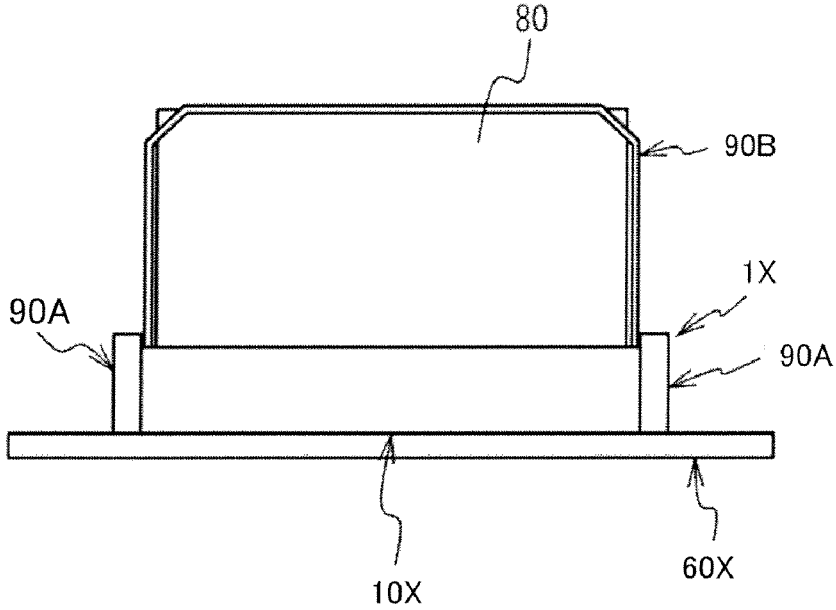
FIG. 2A is a diagram illustrating a relationship between a card and a card connector having a structure different from the card connector illustrated in FIGS. 1A and 1B.
Figure 2B:
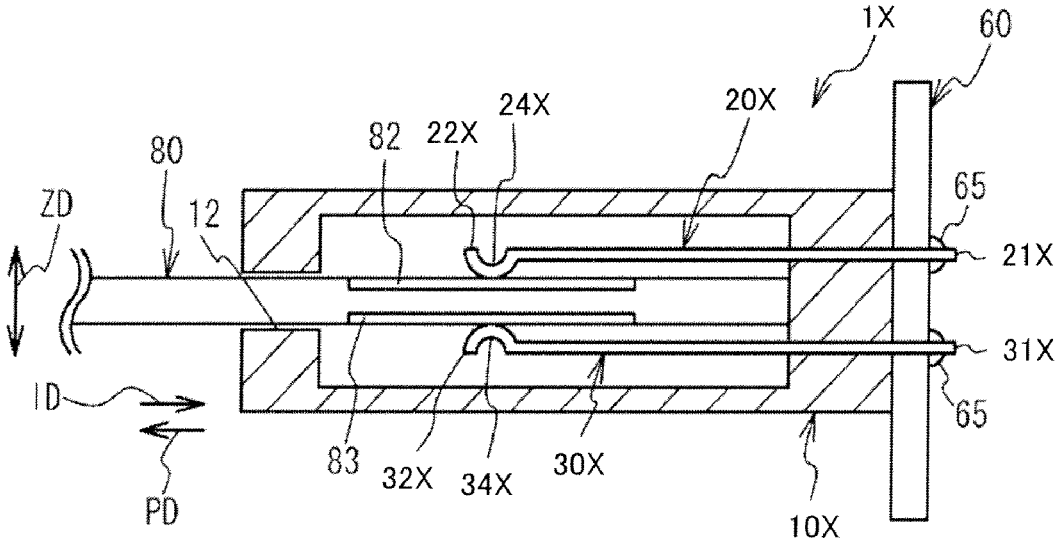
FIG. 2B is a diagram illustrating an inner configuration of the connector illustrated in FIG. 2A.

FIGS. 2A and 2B illustrate a card connector 1X having a structure different from the card connector 1 according to the first embodiment. In FIG. 2A, the card 80 is inserted into the card connector 1X which has latch mechanisms 90A provided at both sides of the housing 10X. Each of the latch mechanisms engages with the card 80 to prevent the card 80 to be dropped off from the housing 10X. The latch mechanisms 90A are separately disposed from the housing 10A such that the latch mechanisms 90A are fixed to the housing 10X after the housing 10X has been assembled to the motherboard 60X.

In FIG. 2A, a fixing frame 90B made of metal is illustrated other than the latch mechanisms 90A. The fixing frame 90B is assembled to the housing 10X after the card 80 has been inserted into the housing 10X. The fixing frame 90B holds tightly the edge(s) of the card 80 to prevent the card 80 form being dropped off from the housing 10X. The latch mechanism 90A or the fixing frame 90B is usually adopted for preventing the card 80 from being incorrectly drawing.

As described above, each of the latch mechanism 90A and the fixing frame 90B are provided as a separate part and assembled to the housing 10X. Accordingly, the use of the latch mechanism 90A or the fixing frame 90B needs an operation for assembling one or both to the housing 1X to obtain the card connector 1X.

On the contrary, the urging members 40 and 50 are provided within the housing 10 according to the first embodiment, which functions to prevent the card 80 from being dropped from the housing 10 by the use of the urging members 40 and 50. Therefore, the use of the card connector 1 do not need an operation to assemble to the housing 10 a separate part(s) for holding the card 80 to the housing 10. As a result, the use of the card connector 1 saves man-hour necessary for an operation for assembling.

When adopting the card connector 1X, a layout of the motherboard 60 should be designed with consideration of assembling the latch mechanism 90A and/or the fixing frame 90B. The consideration led to a decreasing area, of the motherboard 60, allowable for mounting electronic components, or the like, because some area is necessary to assemble the latch mechanism 90*a* and/or the fixing frame 90B. However, use of the card connector 1 according to the first embodiment do not need area for assembling the additional parts such as the latch mechanism 90A or the fixing frame 90B, because the drop preventing mechanism is provided within the card connector 1. Therefore, the allowable area or space for mounting electronic elements or the like will be wider than that at the use of the card connector 1X.

With reference to FIG. 2B which illustrates the inner structure of the housing 10x, a detail of the card connector 1X will be described. In the housing 10x, there are provided contacts 20X and 30X which have single contact portions 24X and 34X, respectively. The fixing ends 21X and 31X are electrically coupled to the motherboard 60, respectively. The contact 20X has at the side of free end 22X the contact portion 24X which contacts to the contact pad 82. The contact 30X has a structure similar to that of the contact 20X.

A case will be described where the card 80 vibrates in the direction ZD, that is, in the direction of the thickness of the card 80. In this case, the contact portions 24X and 34X will slide on the contact pads 82 and 83, respectively, which leads to a possibility that the card 80 will move in the card ejection direction PD to result in dropping off from the housing 10X. The card 80 tends to vibrate in the direction ZD when the motherboard 60 positions in the vertical direction within an electronic apparatus. Thus, the present inventors have newly found that the card 80 tends to drop off from the connecter when the card 80 vibrates in the direction ZD perpendicular to the directions ID and PD, where the directions ZD, ID and PD are the direction of the thickness of the card 80, the insertion direction and the drawing direction, respectively.

However, the card 80 may be prevented from dropping off from the card connector 1 according to the first embodiment due to the function of the urging members 40 and 50 which actuate the corresponding contacts toward the card 80, respectively.

In detail will be described a mechanism of preventing the card 80 from dropping off from the card connector 1. With reference to FIG. 1B, the contacting portion 44 actuates toward contact pad 82 a portion of the contact 20 between the contact portions 24 and 25. When the card 80 vibrates in the direction ZD, the contact 20 and the urging member 40 bend, which leads to a movement of the position of the contacting portion 44 relative to the contact 20. However, the positions of the contact portions 24 and 25 on the contact pad 82 do not easily move, because the urging member 40 actuates the contact 20 toward the card 80. In similar way, the positions of the contact portions 34 and 35 on the contact pad 83 are not easily move. Accordingly, the movement of the card 80 is prevented form moving in the card ejection direction PD, that is, the ejection direction of the card 80, which results in preventing the card 80 from dropping off form the housing 10.

In the present embodiment illustrated in FIG. 1B, the contacts 20 and 30 each includes a plural contact portions, such as contact portions 24 and 25 for the contact 20 and contacts portions 34 and 35 for the contact 30. Since the increase of contacting portions may lead to increase of sliding resistance, the sliding resistance produced between the card 80 and the contacts 20 and 30 is greater than that between the card 80 and the contacts 20X and 30X of the card connector 1X illustrated in FIG. 2B when the card 80 moves in the card ejection direction PD in each of FIGS. 1B and 2B. Accordingly, the movement of the card 80 from the housing 10 may be prevented more securely that that of from the housing 10X.

Further, there are provided a plural contacting portions between the contact 20 and the contact pad 82 and between the contact 30 and the contact pad 83. Therefore, when one of the contact portions 24 and 25 and one of the contact portions 34 and 35 are contacting to respectively the contact pads 82 and 83, the electrical connection is ensured between the card 80 and the motherboard 60. Thus, the configuration of the card connector 1 may have an improved reliability of the electrical connection.

The distances from the fixed end 21 to the contact portion 24 and from the fixed end 31 to the contact portion 34 are short and the fixed ends 21 and 31 are fixed securely to the housing 10. Therefore, the contacts 20 and 30 do not easily bend at portions from the fixed end 21 and 31 to the contact portion 24 and 34, respectively. Accordingly, the contact portions 24 and 34 behave as a limiter for permitting little a range of the allowable movement of the card 80 in the direction ZD, that is, in the direction of thickness of the card 80. Thus, the card 80 is prevented from dropping off from the card connector 1 or the housing 10.

In addition, the contact portions 24 and 34 of the contacts 20 and 30, respectively, are positioned at the end side of the housing 10. That is, the contact portions 24 and 34 are holding the card 80 at the portion which is nearer to the gravity center of the card 80 than the portion of the card 80 held by the contact portions 25 and 35. Accordingly, the vibration of the card 80 in the direction ZD is effectively prevented.

The contact 20 and the urging member 40 face oppositely each other and extend in the opposite directions as illustrated in FIG. 2B. This relationship is applicable to the contact 30 and the urging member 50. The more detail will be described. The fixed ends 21 and 31 are fixed at the tip end side of the housing 10. When the fixed ends 21, 31, 41, and 51 are all provided at the same side of the housing 10, such as the tip end side or the end side close to the motherboard 60, it is necessary to provide the holes for each fixed end at one of the end sides of the housing 10. Providing the holes in this way may result in the housing 10 having a weaken portion. However, as illustrated in FIG. 1B, the fixed ends 21 and 31 are provided at the tip end side and the fixed ends 41 and 51 are provided at the end side close to the motherboard 60, which leads to prevent the strength of the housing 10 from being weaken partially.

Second Embodiment

Figure 3A:
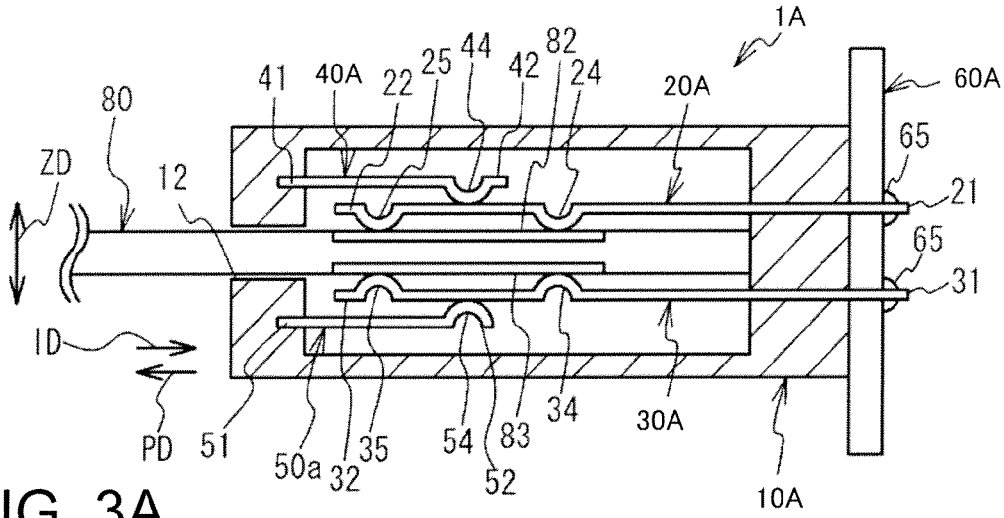
FIGS. 3A to 3C are diagrams illustrating inner configurations of card connectors according to second to fourth embodiments, respectively.

FIG. 3A illustrates the inner structure of the card connector 1A according to the second embodiment. The same references for the first embodiment will be used for similar parts in the second embodiment. In the second embodiment, the fixed end 21 of the contact 20A and the fixed end 31 of the contact 30A are fixed to the base side of the housing 10A. The fixed end 41 of the urging member 40A and the fixed end 51 of the urging member 50A are fixed to the tip end side of the housing 10A. The contacts 20A and 30A extend in the card ejection direction PD. The urging members 40A and 50A extend in the card insertion direction ID. The fixed end 21 of the contact 20A and the fixed end 31 of the contact 30A pass through the motherboard 60A and are electrically coupled to the motherboard 60A. The structure described above may prevent the card 80 from dropping off from the housing 10A.

Third Embodiment

Figure 3B:
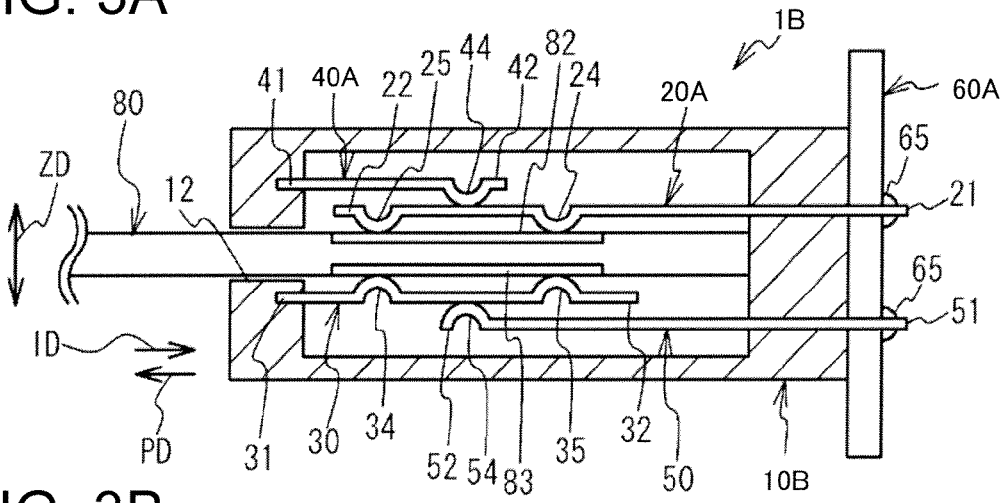

FIG. 3B illustrates the inner structure of the card connector 1B according to the third embodiment. The contact 20A extends in the direction the card ejection direction PD and the contact 30 extends in the card insertion direction ID. The urging member 40A extends in the card insertion direction ID and the urging member 50 extends in the card ejection direction PD. The contacts 20A and 30 extend in the opposite directions each other. In addition, the contact 20A and the urging member 40A for actuating the contact 20A extend also in the opposite directions each other. The contact 20A and the urging member 50 are electrically coupled to the motherboard 60B. As described above, in the third embodiment, the contacts 20A and 30 extend in the opposite directions each other, while the contact 20A and the urging member 40A extend the opposite directions each other and the contact 30 and the urging member 50 extend also in the opposite directions each other. As a result, the structure described above prevents the housing 10B from forming at the base end side or the tip end side of the housing 10B the holes passed through by the contacts 20A and 30 and the urging members 40A and 50. Accordingly, the structure according to the third embodiment avoids the decrease in the strength of the housing 10B caused by the concentration of the holes at one side of the tip end or the base end sides of the housing 10B.

Fourth Embodiment

Figure 3C:
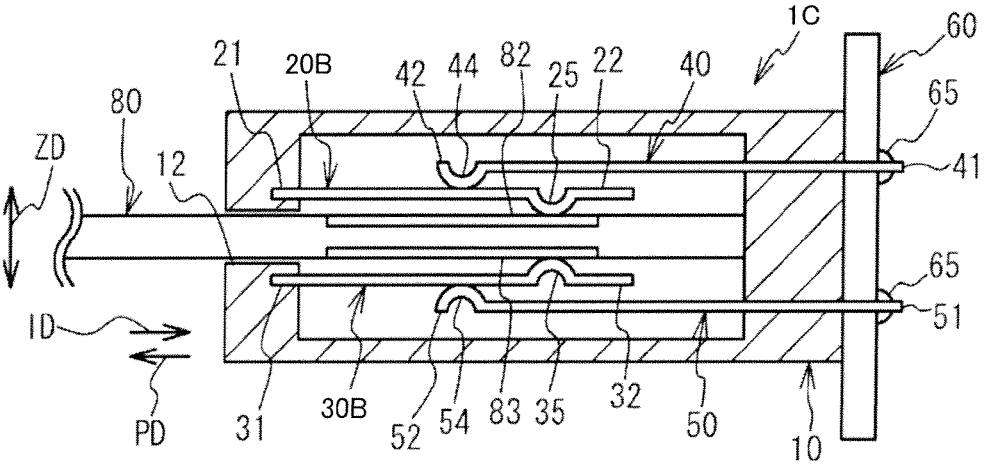

FIG. 3C illustrates the inner structure of the card connector 1C according to the fourth embodiment. As illustrated in FIG. 3C, the contacts 20B and 30B each have single contact portion 25 and 35, respectively. The contact 20B is forced by the urging member 40 through the contacting portion 44 which contacts a portion between the fixed end 21 and the contact portion 25. Similarly, the urging member 50 forces the contact 30B through the contacting portion 54 which contacts a portion between the fixed end 31 and the contact portion 35. Thus, the urging members 40 and 50 actuate the contacts 20B and 30B toward the card 80, respectively, to prevent the card 80 from dropping off from the card connector 1C.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A card connector for electrically coupling a card with a motherboard, comprising:

a housing to and from which a contact pad of the card is inserted and ejected, the housing being mountable on the motherboard;

a pair of contacts configured to hold the card between the pair of the contacts and to be electrically coupled with the contact pads of the card inserted into the housing, the pair of contacts extending in a first direction; and a pair of urging members configured in the housing to force the pair of the contacts toward the card, the pair of the urging members extending in a second direction opposite to the first direction.

2. The card connector according to claim 1, wherein at least one of the pair of the contacts includes a plurality of contacting portions connecting the contact pad.

3. The card connector according to claim 2, wherein at least one of the pair of the urging members forces toward the card a portion between at least two of the plurality of the contacting portions.

4. The card connector according to claim 1, wherein at least one of the pair of the urging members is electrically coupled with at least one of the pair of the contacts and with the motherboard on which the housing is mounted.

5. The card connector according to claim 2, wherein at least one of the pair of the urging members is electrically coupled with at least one of the pair of the contacts and with the motherboard on which the housing is mounted.

6. The card connector according to claim 3, wherein at least one of the pair of the urging members is electrically coupled with at least one of the pair of the contacts and with the motherboard on which the housing is mounted.

7. The card connector according to claim 1, wherein at least one of the pair of the contacts is electrically coupled with the motherboard on which the housing is mounted.

8. The card connector according to claim 2, wherein at least one of the pair of the contacts is electrically coupled with the motherboard on which the housing is mounted.

9. The card connector according to claim 3, wherein at least one of the pair of the contacts is electrically coupled with the motherboard on which the housing is mounted.

10. An electronic apparatus comprising:

a motherboard; and a card connector for electrically coupling a card with the motherboard including, a housing to and from which a contact pad of the card is inserted and ejected, the housing being mountable on the motherboard;

a pair of contacts configured to hold the card between the pair of the contacts and to be electrically coupled with the contact pads of the card inserted into the housing, the pair of contacts extending in a first direction; and a pair of urging members configured in the housing to force the pair of the contacts toward the card, the pair of the urging members extending in a second direction opposite to the first direction.

11. The electronic apparatus according to claim 10, wherein at least one of the pair of the contacts includes a plurality of contacting portions connecting the contact pad.

12. The electronic apparatus according to claim 11, wherein at least one of the pair of the urging members forces toward the card a portion between at least two of the plurality of the contacting portions.

13. The electronic apparatus according to 10, wherein at least one of the pair of the urging members is electrically coupled with at least one of the pair of the contacts and with the motherboard on which the housing is mounted.

14. The electronic apparatus according to claim 10, wherein at least one of the pair of the contacts is electrically coupled with the motherboard on which the housing is mounted.

* * * * *